United States Patent [19]

Schneider et al.

[11] Patent Number: 4,497,097

[45] Date of Patent: Feb. 5, 1985

[54] PREPARATION OF IMPROVED THERMOPLASTIC SPUN FLEECES

[75] Inventors: Heinrich Schneider, Dornach; Johann Hammerschmidt, Linz-Plesching, both of Austria

[73] Assignee: Chemie Linz Aktiengesellschaft, Linz, Austria

[21] Appl. No.: 110,320

[22] Filed: Jan. 8, 1980

[30] Foreign Application Priority Data

Jan. 11, 1979 [DE] Fed. Rep. of Germany ..... 2900888
Jun. 19, 1979 [DE] Fed. Rep. of Germany ..... 2924652

[51] Int. Cl.[3] ..... D04H 3/10
[52] U.S. Cl. ..... 28/112; 28/103
[58] Field of Search ..... 28/103, 112; 19/161.1; 428/300

[56] References Cited

U.S. PATENT DOCUMENTS 4,105,381 8/1978 Platt et al. ..... 28/112 X
4,117,578 10/1978 Forster ..... 28/112
4,154,889 5/1979 Platt ..... 428/300

FOREIGN PATENT DOCUMENTS 1635634 7/1970 Fed. Rep. of Germany .
46-6115 12/1971 Japan ..... 28/112
1134401 11/1968 United Kingdom ..... 28/112
1213441 11/1970 United Kingdom .
1371863 10/1974 United Kingdom .
1389400 4/1975 United Kingdom .
1535988 12/1978 United Kingdom .

*Primary Examiner*—Robert R. Mackey
*Attorney, Agent, or Firm*—Mark Dryer

[57] ABSTRACT

In spun fleeces of thermoplastics in which the filaments are in approximately random arrangement, which fleeces have been strengthened by needle-punching and which have a higher tensile strength in one direction than in the direction at right angles thereto, the said tensile strengths are approximated to one another by stretching the fleece by 20 to 200% of the original length, in the direction of the lower tensile strength, at a temperature which is 85° to 25° C. below the crystallite melting point, while either maintaining the length in the direction at right angles to the stretching direction, or changing it, beforehand or simultaneously, by an amount within the range of ±10% of the original length.

4 Claims, 1 Drawing Figure

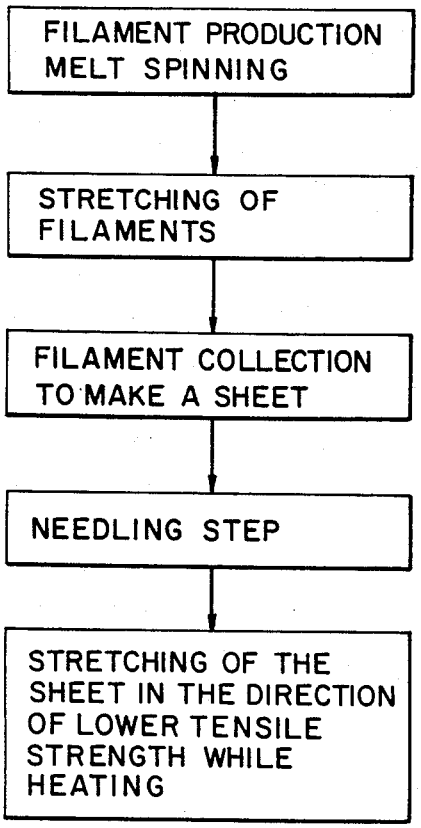
FILAMENT PRODUCTION
MELT SPINNING
STRETCHING OF
FILAMENTS
FILAMENT COLLECTION
TO MAKE A SHEET
NEEDLING STEP
STRETCHING OF THE
SHEET IN THE DIRECTION
OF LOWER TENSILE
STRENGTH WHILE
HEATING

PREPARATION OF IMPROVED THERMOPLASTIC SPUN FLEECES

BACKGROUND OF THE INVENTION

The present invention relates to a process for the preparation of spun fleeces made from thermoplastic synthetic resins, hereinafter termed thermoplastics, in which fleeces the properties, particularly the tensile strength thereof, are improved.

Spun fleeces or spunbonded webs, which are built up of virtually continuous filaments of thermoplastics which are laid down in approximately random arrangement, have been known for a considerable time. Generally, they are produced by laying down the filaments, immediately after they have been spung and stretched, mainly by means of air. The degree to which remnants of parallel fiber bundles are present varies with the lay-down method used. An ideal, completely unorientated random arrangement is mostly not achieved, so that such fleeces or webs almost always have a higher tensile strength in one direction than in the direction at right angles thereto.

For a number of applications, for example, in civil engineering, it is not the strength in one direction, but the strength in all directions, which matters. This means that when the material is used, the lowest tensile strength is the determining factor, so that the thickness of the web must also be selected in accordance with the lowest tensile strength. This in turn means that it becomes more expensive to use the fleece, a fact which stands in the way of certain large industrial applications.

United Kingdom patent specification No. 1,535,988 describes a process in which the properties of staple fiber webs wherein the individual fibers are orientated at right angles to the machine direction are improved by stretching the webs first in the longitudinal direction, then needle-punching them, then again stretching them in the longitudinal direction and finally stretching them in the transverse direction. This increases the dimensional stability and strength of these webs.

Also, it is known from United Kingdom patent specification No. 1,371,863 that in the case of non-consolidated randomly arranged staple fiber webs consisting of relatively short fibers, which have been provided with a regular pattern by means of mechanical or fluid forces, the transverse tensile strength may be improved by stretching in the transverse direction, accompanied by shrinkage in the longitudinal direction, without this stretching destroying the pattern consisting of regular thick and thin areas. Rather, the pattern may be completely reconstituted by another aftertreatment with fluid forces, which bring about a reorientation of the relatively short fibers.

Finally, West German Offenlegungsschrift No. 1,635,634 discloses a method of improving the longitudinal tensile strength of webs, which as a result of plaiting-down have a strong orientation in the transverse direction, by stretching them in the longitudinal direction during needle-punching, This stretching, which at the same time results in an uncontrollable reduction in width, is intended to have the effect that the fiber pile, which in the plaiter is laid down with the layers at angle of 10° to 15° to one another, is so distorted during the first needle-punching operation that the fibers ultimately settle at an angle of 45° to one another, and are fixed in this position.

This process, which may be carried out, during needle-punching, only by breaking it down into numerous individual small stretching steps, requires expensive equipment, since, for example, the needle-punching machine must work with a low punching speed but a high output speed and furthermore should execute a side-to-side motion since otherwise stripes are produced in the web. This Offenlegungsschrift also points out that simple stretching of the plaited-down web is not possible since it results in the formation of thin areas which tear on further stretching.

Stretching to improve the properties also has been proposed for webs of continuous filaments. According to United Kingdom patent specification No. 1,213,441, webs which are welded or glue-bonded at the cross-over points are stretched, in at least one direction, to the extent that the surface area increases by a factor of up to about 15. Since the cross-over points in the webs used for this process are rigidly fixed, this treatment results in a stretching of the individual filaments, which vary greatly in individual gauge, and results in fluctuations in gauge, of the individual filaments, by a power of ten. Stretching in this process is effected over a heated brake pad.

It now has been found that the tensile strengths of a spun fleece in which the filaments are in approximately random arrangement may be substantially equalized in directions at right angles to one another, the lower tensile strength in one of the two directions being substantially increased, without however the filaments themselves being stretched and the filament gauge becoming non-uniform, if a needle-punched fleece is stretched, at an elevated temperature, in the direction which has the lower tensile strength.

As used herein the term "random arrangement" is intended to mean the substantial absence of any anisotropy in the arrangement of the individual filaments.

As a result of this stretching step, the lower tensile strength is increased though at the same time the surface area of the fleece is enlarged at the expense of the weight per square meter. The fact that nevertheless a higher minimum tensile strength is achieved now offers the possibility of substantially more economical use of the fleece, above all in underground civil engineering, such as road making, tunnel construction, construction of embankments and hydraulic civil engineering, since what matters in these applications is virtually only the force-elongation characteristics, but not the weight of the web per square meter, and accordingly larger surfaces may be covered with the same weight of a fleece material.

The fact that a needle-punched fleece, in which the cross-over points are not so consolidated that they will not open up, may be reinforced is surprising since it was to be expected that any thin areas which might be present would be accentuated or that holes might even appear. However, this is not the case. On the contrary, a more uniform distribution of the randomly arranged filaments is achieved, with filaments lying in loops passing into the stretched position with increasing degree of stretching, and thereby imparting a higher strength to the fleece. However, this may be achieved only if the stretching is carried out within a certain temperature range which depends on the crystallite melting point.

SUMMARY OF THE INVENTION

Accordingly, the present invention provides a process for improving the tensile characteristics of a spun fleece made from virtually continuous filaments of thermoplastics in approximately random arrangement, which fleece initially has a higher tensile strength in one direction than in the direction at right angles thereto, and which has been consolidated by needle-punching, which comprises stretching by 20 to 200% of the original length, in the direction of the lower tensile strength, at a temperature which is 85° to 25° C. below the crystallite melting point, while either maintaining the length in the direction at right angles to the stretching direction, or changing it, beforehand or simultaneously, by an amount within the range of ±10% of the original length.

It is a precondition for the success of the process according to the invention that the starting material is a fleece which has been consolidated or strengthened by needle-punching. To achieve good properties, above all at relatively high stretch ratios, it is advantageous not to select an excessively light needle-punching treatment. It is preferred to start from fleeces which have been needle-punched to the point that their increase in strength as a result of the needle-punching is at least 50% of the optimum increase in strength achievable by needle-punching. This situation prevails, for example, about 100 punches/cm$^2$ when using needles of type 15×18×34/3 inch, or at 120 punches/cm$^2$ when using needles of type 15×16×36/3 inch. Particularly advantageous results are obtained by employing fleeces which have been processed with the stated types of needles, with about 180 to 200 punches/cm$^2$.

Continuous filament fleeces of the above mentioned type mostly have a lower tensile strength in the transverse direction. According to the present invention, these fleeces are stretched in the transverse direction to the degree specified according to the invention, and this stretching may be carried out, for example, in a tenter frame which is in itself known.

However, it is also possible to use a stretching apparatus in which the fleece is gripped by discs provided with teeth at the periphery, the plane of the discs being approximately at right angles to the plane of the fleece and the discs being so arranged at an acute angle to the machine direction of the fleece, that as the fleece passes the periphery of the discs it is stretched outwards. Such a device is described, for example, in United Kingdom patent specification No. 1,389,400.

If, however, the continuous filament fleece is brought to a particular thickness of fleece by plaiting-down before needle-punching, it is mostly the longitudinal direction which exhibits the lower tensile strength. In that case, the fleece must be stretched subsequently in the longitudinal direction, which may be achieved particularly advantageously by a roller stretching process which is in itself known, with a short gap between the rollers. However, any other known longitudinal stretching process may be used, but excessive reduction in width of the fleece must be avoided in order to adhere to the limits specified according to the invention. This may be achieved, for example, in that longitudinal stretching zones are interrupted by zones in which the fleece is again brought to the width precribed according to the invention, which should be within ±10% of the original width, in a transverse stretching device. In the case of a plaited-down fleece, the stretching process according to the invention again influences the random arrangement of the continuous filaments. Even when plaited-down continuous filament fleeces are used, the stretching process according to the invention has nothing to do with a reorientation of individual fibers which lie at a certain angle which originates from the plaiting-down process and which undergoes change, as is achieved in the process of stretching staple fiber fleeces during needle-punching (West German Offenlegungsschrift No. 1,635,634).

The choice of the degree of stretching within the range according to the invention depends on the values to be achieved. If, for example, the tensile strength in the weaker direction is to be raised by, for example, 15 to 20% without wishing to lose strength in the longitudinal direction, it will be advantageous to choose slight stretching, namely 20 to 30%. The higher the chosen degree of stretching in the weak direction, the greater is the reduction in the tensile strength in the stronger direction, so that, for example, stretching by 60 to 100% results in fleeces which are approximately isotropic in respect of tensile strength, and whose tensile strengths lie between the original longitudinal strength and the original transverse strength. Since it is the lowest tensile strength which determines the suitability for an end use, after the treatment according to the invention, the resulting fleece may be exposed to more severe load than the starting fleece.

The process according to the invention is applicable to continuous filament fleeces made from any thermoplastic, such as polyamide, polyester or polyolefin. Fleeces of propylene homopolymers and copolymers, and of polyesters, are particularly preferred.

A flow sheet showing the treatment steps leading to the process of the invention is set out in the accompanying drawing.

The following Examples illustrate the process according to the invention. The values for the tensile strength and the elongation at break given in the Examples have been determined according to DIN 53,857 (corresponding to ASTM D-1682/64, 1970), using 5 cm strips of a length of 20 cm, the force being given in Newtons (N). The filament gauge is given in the international unit dtex equivalent to the former used unit denier.

EXAMPLE 1

A needle-punched continuous filament fleece of polypropylene, having the following characteristics:

| | |
|---|---|
| filament gauge | 11 dtx |
| Weight per unit area | 240 g/m$^2$ |
| Needle-punching | 60 punches/cm$^2$ with 15 × 18 × 34/3 inch needles c.b. (= close barb), corresponding to 30–40% of the optimum strength achievable with needle-punching |
| Tensile strength | longitudinal 640 N |
| Elongation at break | longitudinal 85% |
| Tensile strength | transverse 305 N |
| Elongation at break | transverse 120% |

is mounted in a tenter frame without longitudinal distortion, and stretched continuously by 20% in the transverse direction at a temperature of 130° C. After leaving the hot air oven, the fleece is taken off the tenter frame and is wound up continuously. It posseses the following characteristics:

| | |
|---|---|
| Weight per unit area | 220 g/m$^2$ |
| Tensile strength | longitudinal 653 N |

-continued

| | |
|---|---|
| Tensile strength | transverse 352 N |
| Elongation at break | longitudinal 61% |
| Elongation at break | transverse 84% |

Accordingly, the fleece has substantially the same longitudinal tensile strength as before, with a transverse strength increased by 50 N.

In contrast thereto, a fleece of weight 200 g/m$^2$ which has been produced by the conventional spinning process and has not been stretched has the following characteristics:

| | |
|---|---|
| Tensile strength | longitudinal 600 N |
| Tensile strength | transverse 245 N |
| Elongation at break | longitudinal 90% |
| Elongation at break | transverse 130% |

Accordingly, the fleece produced according to the invention is superior in respect of tensile strength.

EXAMPLE 2

The same fleece as described in Example 1 is introduced into a tenter frame and is taken off at a speed such that it is stretched by 10% in the longitudinal direction at room temperature before the side edges are gripped by the holder members. The fleece is then stretched by 20% transversely, at 130° C. The resulting fleece after having been released from the tenter frame and cooled has the following characteristics:

| | |
|---|---|
| Weight per unit area | 208 g/m$^2$ |
| Tensile strength | longitudinal 624 N |
| Tensile strength | transverse 348 N |
| Elongation at break | longitudinal 57% |
| Elongation at break | transverse 86% |

In contrast, a continuous filament fleece of polypropylene, which has a weight of 200 g/m$^2$ and has been produced by spinning and laying down, has a longitudinal tensile strength of only 570 N and a transverse tensile strength of 230 N, with an elongation at break of 90% in the longitudinal direction and 135% in the transverse direction.

EXAMPLE 3

A heavily needle-punched continuous filament fleece of polypropylene, having the following characteristics:

| | |
|---|---|
| Filament gauge | 10 dtex |
| Weight per unit area | 290 g/m$^2$ |
| Tensile strength | longitudinal 690 N |
| Elongation | longitudinal 91% |
| Tensile strength | transverse 357 N |
| Elongation | transverse 139% |
| Needle-punching | 180 punches/cm$^2$ with 15 × 18 × 34/3 inch needles c.b. (= close barb), corresponding to 85% of the optimum strength achievable with needle-punching |

is stretched transversely at 40% at 135° C. in a tenter frame, without prior longitudinal direction. After cooling, the fleece has the following characteristics:

| | |
|---|---|
| Weight per unit area | 230 g/m$^2$ |
| Tensile strength | longitudinal 558 N |
| Elongation | longitudinal 76% |
| Tensile strength | transverse 438 N |
| Elongation | transverse 84% |

In contrast, a fleece weighing 230 g/m$^2$ and produced like the fleece used as the starting material has a longitudinal tensile strength of 650 N and a transverse tensile strength of only 290 N, and an elongation at break of 85% in the longitudinal direction and 125% in the transverse direction.

EXAMPLE 4

A polypropylene fleece having the following characteristics:

| | |
|---|---|
| Filament gauge | 10 dtex |
| Initial weight | 240 g/m$^2$ |
| Needle-punching | 200 punches/cm$^2$ with 15 × 18 × 36/3 inch needles, c.b. (= close barb), corresponding to 85% of the optimum strength achievable with needle-punching |
| Tensile strength | longitudinal 656 N |
| Elongation | longitudinal 85% |
| Tensile strength | transverse 310 N |
| Elongation | transverse 136% |

is stretched transversely by 60% at 135° C. in a tenter frame, without prior longitudinal distortion.

The fleece thus obtained has the following characteristics:

| | |
|---|---|
| Weight per unit area | 188 g/m$^2$ |
| Tensile strength | longitudinal 490 N |
| Elongation | longitudinal 75% |
| Tensile strength | transverse 364 N |
| Elongation | transverse 51% |

By comparison, a fleece which has been produced by the same process as the starting fleece but which has a weight of 180 g/m$^2$, possesses a longitudinal strength of 530 N and a transverse strength of 200 N, and an elongation at break of 95% in the longitudinal direction and 150% in the transverse direction.

EXAMPLE 5

The fleece described in Example 4 is stretched transversely by 60% at 140° C. and is at the same time allowed to shrink by 10% in the longitudinal direction. This gives a fleece having the following characteristics:

| | |
|---|---|
| Weight per unit area | 195 g/m$^2$ |
| Tensile strength | longitudinal 502 N |
| Tensile strength | transverse 389 N |
| Elongation | longitudinal 78% |
| Elongation | transverse 50% |

By comparison, a fleece which has been produced by the same process as the starting fleece but which has a weight of 200 g/m$^2$ has a longitudinal tensile strength of 570 N, a transverse tensile strength of 230 N and an elongation at break of 90% in the longitudinal direction and 135% in the transverse direction.

EXAMPLE 6

A needle-punched continuous filament fleece of polypropylene, having the following characteristics:

| | |
|---|---|
| Filament gauge | 11 dtex |
| Weight per unit area | 386 g/m$^2$ |
| Tensile strength | longitudinal 1,139 N |
| Elongation | longitudinal 110% |
| Tensile strength | transverse 514 N |
| Elongation | transverse 152% |
| Needle-punching | 120 punches/cm$^2$ needle type 15 × 18 × 36/3" c.b. (= close barb) - embossed |

is stretched continuously by 100% transversely at 135° C. in a tenter frame, without prior longitudinal distortion. After leaving the hot air oven, the fleece has the following characteristics:

| | |
|---|---|
| Weight per unit area | 216 g/m$^2$ |
| Tensile strength | longitudinal 701 N |
| Elongation | longitudinal 51% |
| Tensile strength | transverse 545 N |
| Elongation | transverse 82% |

The original large difference in the tensile strength, of longitudinal:transverse=2.2:1 was equalized by the stretching process to the ratio longitudinal:transverse of 1.2:1, and the transverse tensile strength, after stretching, of the 44% lighter fleece had increased by 6% from 514 N to 545 N.

EXAMPLE 7

A needle-punched continuous filament fleece of polypropylene, having the following characteristics:

| | |
|---|---|
| Filament gauge | 11 dtex |
| Weight per unit area | 238 g/m$^2$ |
| Tensile strength | longitudinal 600 N |
| Elongation | longitudinal 107% |
| Tensile strength | transverse 320 N |
| Elongation | transverse 146% |
| Needle-punching | 120 punches/cm$^2$ needle type 15 × 18 × 36/3" c.b. (= close barb) - embossed |

is stretched transversely by 120% at 135° C. in a tenter frame, without prior longitudinal distortion. After leaving the hot air oven and cooling, the fleece has the following characteristics:

| | |
|---|---|
| Weight per unit area | 112 g/m$^2$ |
| Tensile strength | longitudinal 400 N |
| Elongation | longitudinal 39% |
| Tensile strength | transverse 240 N |
| Elongation | transverse 82% |

With a decrease in the weight per unit area of 53%, the longitudinal tensile strength was reduced by only 33% and the transverse tensile strength by only 25%; however, the ratio of longitudinal tensile strength:transverse tensile strength was levelled out from 1.87:1 to 1.66:1.

EXAMPLE 8

A needle-punched fleece according to Example 6, having the following characteristics:

| | |
|---|---|
| Filament gauge | 11 dtex |
| Weight per unit area | 184 g/m$^2$ |
| Tensile strength | longitudinal 503 N |
| Elongation | longitudinal 94% |
| Tensile strength | transverse 224 N |
| Elongation | transverse 133% |
| Needle-punching | 120 punches/cm$^2$ needle type 15 × 18 × 36/3" c.b. (= close barb) - embossed |

is stretched transversely by 140% at 135° in a tenter frame, without prior longitudinal stretching. After leaving the hot air oven and cooling, the fleece has the following characteristics:

| | |
|---|---|
| Weight per unit area | 86 g/m$^2$ |
| Tensile strength | longitudinal 285 N |
| Elongation | longitudinal 39% |
| Tensile strength | transverse 171 N |
| Elongation | transverse 76% |

With a decrease in the weight per unit area of 53%, the longitudinal tensile strength decreased by 43% and the transverse tensile strength by only 25% as a result of the stretching process. In contrast, the ratio of longitudinal tensile strength:transverse tensile strength was converted from 2.2:1 to 1.66:1.

EXAMPLE 9

A needle-punched fleece according to Example 6, having the following characteristics:

| | |
|---|---|
| Filament gauge | 11 dtex |
| Weight per unit area | 298 g/m$^2$ |
| Tensile strength | longitudinal 620 N |
| Elongation | longitudinal 101% |
| Tensile strength | transverse 320 N |
| Elongation | transverse 163% |
| Needle-punching | 120 punches/cm$^2$ needle type 15 × 18 × 36/3" c.b. (= close barb) - embossed |

is stretched transversely by 180% at a temperature of 135° C. in a tenter frame, without prior longitudinal distortion. After cooling, the fleece has the following characteristics:

| | |
|---|---|
| Weight per unit area | 116 g/m$^2$ |
| Tensile strength | longitudinal 480 N |
| Elongation | longitudinal 29% |
| Tensile strength | transverse 260 N |
| Elongation | transverse 102% |

With a decrease in the weight per unit area of 62%, the longitudinal tensile strength decreased by only 33% and the transverse tensile strength by only 36% after the stretching process. The ratio of longitudinal tensile strength:transverse tensile strength was somewhat reduced from 1.93:1 to 1.84:1.

EXAMPLE 10

A needle-punched fleece according to Example 6, having the following characteristics:

| | |
|---|---|
| Filament gauge | 11 dtex |
| Weight per unit area | 184 g/m$^2$ |
| Tensile strength | longitudinal 503 N |

-continued

| | |
|---|---|
| Elongation | longitudinal 94% |
| Tensile strength | transverse 224 N |
| Elongation | transverse 133% |
| Needle-punching | 120 punches/cm$^2$<br>needle type 15 × 18 × 36/3" c.b.<br>(= close barb) - embossed |

is stretched transversely by 140% at a temperature of 135° C. in a tenter frame, with a longitudinal distortion of 10%. After cooling, the fleece has the following characteristics:

| | |
|---|---|
| Weight per unit area | 82 g/m$^2$ |
| Tensile strength | longitudinal 290 N |
| Elongation | longitudinal 37% |
| Tensile strength | transverse 168 N |
| Elongation | transverse 78% |

With a decrease in the weight per unit area of 66%, the longitudinal tensile strength decreased by only 42% and the transverse tensile strength by only 25% as a result of the stretching process. In contrast, the ratio of longitudinal tensile strength:transverse tensile strength was reduced from 2.25:1 to 1.72:1.

EXAMPLE 11

A needle-punched fleece according to Example 6, having the following characteristics:

| | |
|---|---|
| Filament gauge | 11 dtex |
| Weight per unit area | 184 g/m$^2$ |
| Tensile strength | longitudinal 503 N |
| Elongation | longitudinal 94% |
| Tensile strength | transverse 224 N |
| Elongation | transverse 133% |
| Needle-punching | 180 punches/cm$^2$<br>needle type 15 × 18 × 36/3" c.b.<br>(= close barb) - embossed |

is stretched transversely by 140% at a temperature of 135° C. in a tenter frame, with a longitudinal shrinkage of 10%. After cooling, the fleece has the following characteristics:

| | |
|---|---|
| Weight per unit area | 91 g/m$^2$ |
| Tensile strength | longitudinal 281 N |
| Elongation | longitudinal 42% |
| Tensile strength | transverse 175 N |
| Elongation | transverse 73% |

With a decrease in the weight per unit area of 51%, the longitudinal tensile strength decreased by only 44% and the transverse tensile strength by only 22% after the stretching process. In contrast, the ratio of longitudinal tensile strength:transverse tensile strength was reduced from 2.25:1 to 1.60:1.

EXAMPLE 12

A needle-punched continuous filament fleece of polypropylene, having the following characteristics:

| | |
|---|---|
| Filament gauge | 10 dtex |
| Weight per unit area | 230 g/m$^2$ |
| Needle-punching | 200 punches/cm$^2$<br>with 15 × 18 × 36/3 inch needles<br>c.b. (= close barb), corresponding to 85% of the optimum strength achievable with needle-punching |
| Tensile strength | longitudinal 620 N |

-continued

| | |
|---|---|
| Elongation at break | longitudinal 90% |
| Tensile strength | transverse 280 N |
| Elongation at break | transverse 150% |

is mounted in a tenter frame without longitudinal distortion, and stretched continuously by 80% in the transverse direction at a temperature of 135° C. After leaving the hot air oven, the fleece is taken off the tenter frame and is wound up continuously. It possesses the following characteristics:

| | |
|---|---|
| Weight per unit area | 150 g/m$^2$ |
| Tensile strength | longitudinal 420 N |
| Elongation at break | longitudinal 75% |
| Tensile strength | transverse 340 N |
| Elongation at break | transverse 57% |

In contrast thereto, a fleece of weight 150 g/m$^2$ which has been produced by the conventional spinning process and has not been stretched has the following characteristics:

| | |
|---|---|
| Tensile strength | longitudinal 470 N |
| Elongation at break | longitudinal 95% |
| Tensile strength | transverse 180 N |
| Elongation at break | transverse 150% |

If the same fleece of weight 230 g/m$^2$ is stretched by only 80% in the transverse direction at 136° C., after it has been stretched beforehand by 10% in the longitudinal direction at room temperature, the resulting fleece has the following characteristics:

| | |
|---|---|
| Weight per unit area | 150 g/m$^2$ |
| Tensile strength | longitudinal 435 N |
| Elongation at break | longitudinal 70% |
| Tensile strength | transverse 356 N |
| Elongation at break | transverse 52% |

We claim:

1. A process for improving the tensile characteristics of a spun fleece made from virtually continuous filaments of thermoplastics in approximately random arrangement, which fleece initially has a higher tensile strength in one direction than in the direction at right angles thereto, and which has been consolidated by needle-punching, which comprises stretching by 20 to 200% of the original length, in the direction of the lower tensile strength, at a temperature which is 85° to 25° C. below the crystalline melting point, while maintaining the length in the direction at right angles to the stretching direction by an amount within the range of ±10% of the original length.

2. A process according to claim 1, in which the starting material is a continuous filament fleece which has been needle-punched to the point that its increase in strength as a result of this needle-punching is more than 50% of the optimum increase in strength achievable by needle-punching.

3. A process according to claim 1, in which the starting material is a continuous filament fleece which has a higher tensile strength in the longitudinal direction than in the transverse direction, and the fleece is stretched in the transverse direction.

4. A process according to claim 1, in which the starting material is a plaited-down continuous filament fleece which has a higher transverse strength than longitudinal strength, and the fleece is stretched in the longitudinal direction.

* * * * *